United States Patent [19]

Shinneman, Jr. et al.

[11] Patent Number: 4,532,736

[45] Date of Patent: Aug. 6, 1985

[54] SHARPENING DEVICE

[76] Inventors: Harold C. Shinneman, Jr., 890 Fremont La., Lake Havasu City, Ariz. 86403; Edward J. Rebish, 1804 Glenridge Rd., Euclid, Ohio 44117; Harold C. Shinneman, Sr., 3400 Roadrunner Dr., Lake Havasu City, Ariz. 86403

[21] Appl. No.: 432,633

[22] Filed: Oct. 4, 1982

[51] Int. Cl.[3] ..... B24B 9/04

[52] U.S. Cl. ..... 51/218 A; 51/220; 51/221 BS; 51/272; 51/273; 76/82.2; 269/79; 269/243; 269/251

[58] Field of Search ..... 51/157–159, 51/221 BS, 285, 271, 272, 214, 273, 221 R, 220, 151, 217 R, 217 A, 218 R, 218 A, 102, 74 R; 269/71, 79, 243, 251, 249; 76/81.7, 82, 82.2, 88

[56] References Cited

U.S. PATENT DOCUMENTS

| | | | |
|---|---|---|---|
| 1,659,257 | 2/1928 | Giampeter | 51/218 A |
| 2,096,422 | 10/1937 | Brunner | 51/220 |
| 2,169,064 | 8/1939 | Williams | 269/249 X |
| 2,444,727 | 7/1948 | Bush | 269/251 |
| 3,084,485 | 4/1963 | Garrison | 51/220 X |
| 3,403,901 | 10/1968 | Servadio | 269/249 X |
| 4,005,553 | 2/1977 | Eller | 51/218 R |

*Primary Examiner*—Robert P. Olszewski
*Attorney, Agent, or Firm*—Gregory J. Nelson

[57] ABSTRACT

A free-standing clamping fixture and grinding wheel system for sharpening scissors and similar workpieces. The clamping fixture has an open frame and a pair of jaws located at the horizontal centerline of the grinding wheel, one of which is carried on a vertically adjustable yoke which also allows some lateral movement. The clamping fixture frame is angularly adjustable to the desired sharpening angle. The free-standing grinding wheel is provided with a moveable wheel guard which locks into place to open or close off an appropriate inlet of a grit removal system.

11 Claims, 23 Drawing Figures

FIG. 13
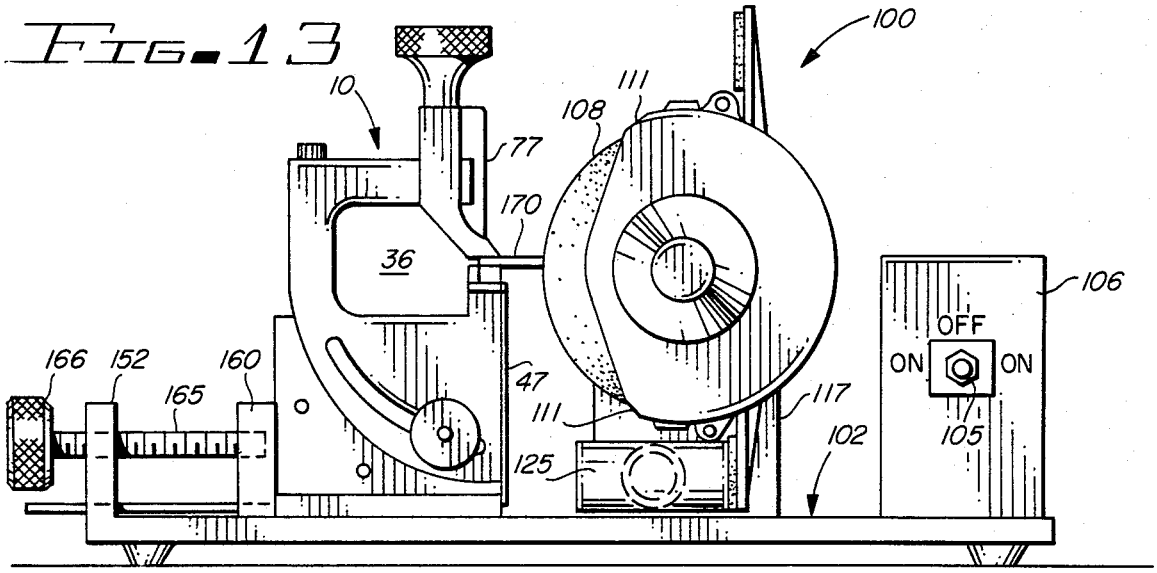
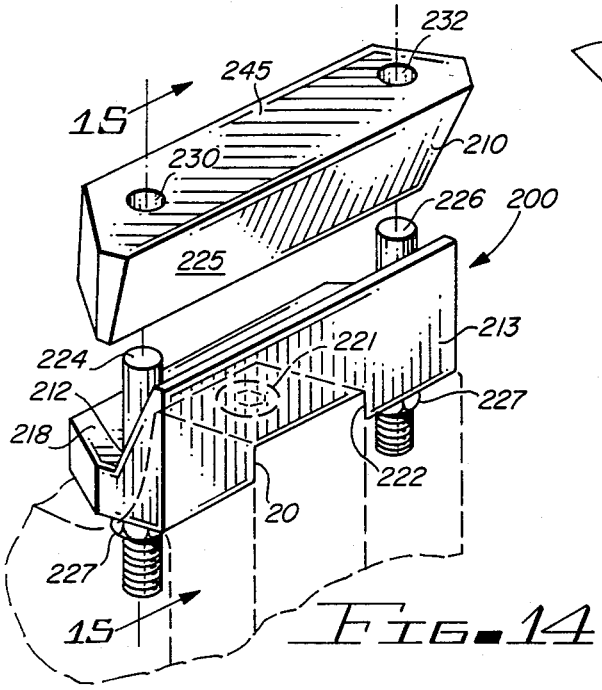
FIG. 14
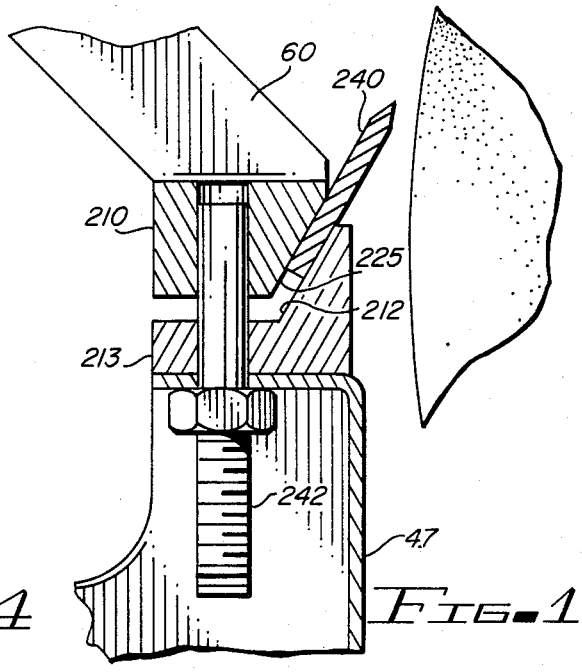
FIG. 15
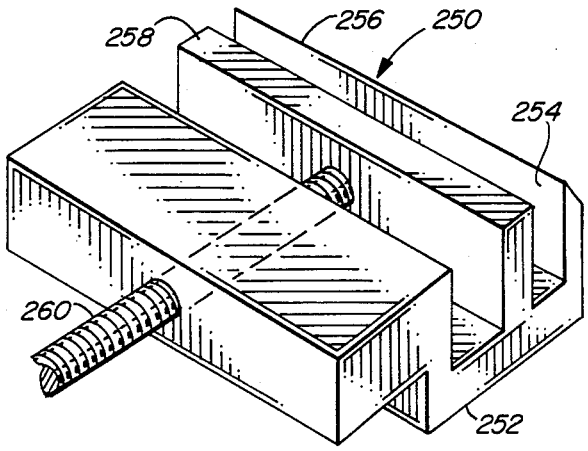
FIG. 16
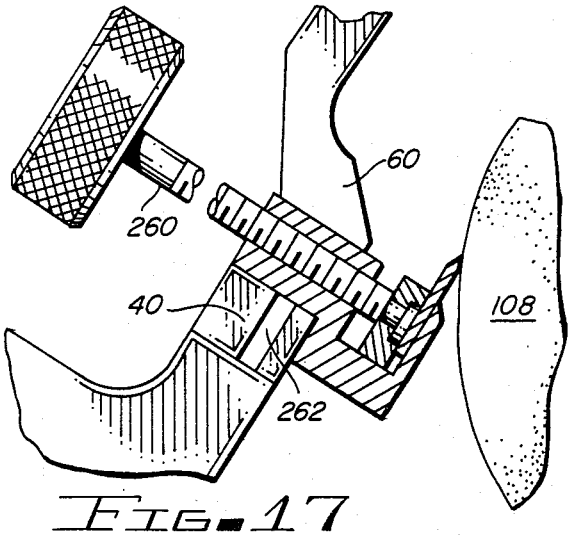
FIG. 17

SHARPENING DEVICE

The present invention is related to a sharpening device. More particularly, the present invention relates to a clamping device for positioning scissors, shears, knives and similar tools for sharpening in conjunction with a grinding apparatus. The invention further relates to an improved grinding apparatus.

BACKGROUND OF THE INVENTION

The sharpening of scissors, shears, knives and similar tools is typically carried out on a device which includes a clamp or fixture for securing the tool as the tool edge is presented to the face of a grinding apparatus. These prior art devices generally fall into one of two categories. The first category consists of independent, manually held and guided clamping devices which are not affixed to the grinding wheel apparatus.

Typical of the first category of devices are those shown in U.S. Pat. Nos. 4,005,553 and 4,095,376. Both of these patents disclose somewhat similar devices which are characterized by a counterbalanced support structure which is designed to pivot downwardly toward the grinding wheel. The shear blade is clamped in the support by a clamping member which includes a trapezoidal-shaped clamping plate. The rear portion of the support is connected to a base member through an adjustment mechanism which allows the setting of the degree of pivotal movement of the counterbalanced support under the force of gravity. U.S. Pat. No. 4,005,553 shows an adjustment mechanism at the clamping plate in the form of a nut and bolt assembly while U.S. Pat. No. 4,095,376 shows a camming lever mechanism which applies the necessary clamping force on the blade to be sharpened. Both of the devices are independent, manually held operated units that the patentee states may be used with any type of grinding wheel apparatus.

The second category of devices are those devices which are integrally or structurally associated with the grinding wheel apparatus. Devices of this type are exemplified by U.S. Pat. Nos. 3,755,971 and 3,574,268. In the latter patent, the device holds a scissors so that it can be adjusted for setting the blade edge of the scissors relative to the periphery of the grinding wheel. The device also has a fixed jaw and a moveable jaw.

The above described devices have deficiencies or limitations which make them either difficult to use or limit the type of tool that can be sharpened. A common serious disadvantage of prior art devices is that these devices do not permit precise variation of the angle between the blades of the shears or scissors and the grinding wheel. Another problem in prior art sharpeners is that they generally do not accomodate various types and sizes of shears and do not apply adequate clamping force to the blade. Still another common disadvantage is that most prior art devices do not provide adequate clamping force to stabilize and secure the blade, particularly if the blade is tapered or is of irregular cross-section. Prior art clamping devices do not tolerate appreciable wear of the grinding apparatus. A principal shortcoming with such prior art devices is that they do not allow for proper clearance of the workpiece at both the clamp and the grinding wheel apparatus.

Other common disadvantages include the absence of ability to pre-set the desired sharpening angle. Further, most prior art sharpening fixtures require trial and error sharpening techniques which results in excess blade material removal and heating of the blade to the point where annealing of the heat-treated edge occurs.

As will become more apparent hereafter, prior art clamp and grinding apparatus are seriously deficient in numerous other ways.

SUMMARY OF THE INVENTION

In view of the foregoing problems, there exist major problems with scissor sharpening devices of the type which include a fixture or clamping device to be used with a grinding wheel. The clamping device of the present invention serves to overcome the disadvantages and deficiencies inherent in the aforementioned devices. Briefly, this is accomplished by providing an improved clamping device which is in the form of an independent, manually held and operated workholder which can be utilized with various known grinding or sharpening wheel apparatus but is particularly effective when used with the grinding device described herein. The clamping device includes a support having a rigid, open frame member which allows lateral clearance and rearward clearance avoiding interference with the scissors blade not being sharpened. With the present design, a moveable clamp jaw is designed as a rigid one-piece yoke which engages two opposite slots of the frame to prohibit front and back movement of the jaws while allowing free lateral movement so equal and direct pressure can be applied along the clamp jaws. The clamp jaw design compensates for blade configuration and taper. A relatively large diameter tightening knob produces high clamping pressure with low torque. The moveable jaw is further provided with a biasing spring to open the clamp as the tightening knob is loosened. A lower, fixed jaw establishes a locating surface and is positioned at the elevation of the horizontal centerline of the grinding wheel. The angle of adjustment of the blade angle is easily set without the use of tools as the clamp frame is adjustable and can be conveniently rotated to the desired calibrated angle and retightening of the knob produces a securely locked position. The present invention utilizes a free-standing grinding apparatus having a wheel driven by a reversible motor. The grinding apparatus is provided with a vacuum system for grit removal in the working zone. A symmetrical, rotatable wheel guard locks into place at opposite sides of the wheel and serves to open or close the appropriate vacuum inlet. The clamping members or jaws are designed to allow for attachment of specialized jaw shapes for other work such as sharpening of knives.

It is therefore an object of the present invention to provide an independent, manually operated workholder or fixture for securing a tool at any given desired angle for sharpening by an independent grinding wheel preferably of a specialized design compatible with the fixture.

It is another object of the present invention to provide a clamping device having clamping jaws capable of securely clamping a large variety of tools of varied configuration for precise and accurate sharpening.

It is still another object of the present invention to provide a clamping device for shears and the like which can accept various other clamping jaws for mounting specialized shaped tools.

It is another object of the present invention to provide a clamping device which provides rigid and secure clamping of the tool to be sharpened and permits precise angular positioning of the blade with respect to the grinding wheel.

It is another object of the present invention to provide a clamping device having a configuration which allows clearance of the workpiece with respect to the clamp mechanism and the associated grinding apparatus.

It is still another object of the present invention to provide a clamping device for a tool to be sharpened in which a pre-set exact blade angle can be established by reference to calibrations on the device.

It is still another object of the present invention to provide a cooperable free-standing, reversible grinding mechanism having an effective grit and particle removal system.

It is an important object of the invention to provide a tool sharpening system including an independent clamp and cooperative grinding which is safe and provides the operator maximum convenience and visibility of the grinding operation.

It is an important object of the present invention to provide a tool sharpening system which is efficient, rugged in design and which facilitates "one-pass" sharpening to minimize blade heating and minimizes the quantity of blade material removed.

The above and other objects and advantages of the present invention will become more apparent from the following description, appended claims, reference being made to the accompanying drawings in which:

BRIEF DESCRIPTION OF THE DRAWINGS

FIG. 13 shows another embodiment of the present invention adapted to sharpen straight edge workpieces;

FIG. 14 is a detail view showing an alternate jaw configuration for sharpening specialized workpieces such as knife blades;

FIG. 15 is a sectional view taken along lines 15—15 of FIG. 14;

FIG. 16 is a perspective view of still another form of work holding vise attachment for use in connection with the clamp of the present invention;

FIG. 17 is a sectional view illustrating the vise arrangement of FIG. 16;

DETAILED DESCRIPTION OF THE INVENTION

In order to fully appreciate the constructional and resulting functional advantages attendant to the present invention, an initial discussion of some of the specific problems occurring with state-of-the-art sharpeners is believed helpful.

One of the most difficult problems encountered with prior art sharpeners is that such devices do not properly sharpen all shapes and configurations of scissors and knives. Another problem is that prior art devices do not allow for proper clearance of the workpiece both at the clamp mechanism and at the grinding wheel structure. As the scissors blade is clamped and presented to the rim or working face of the grinding wheel, the blade not being sharpened is substantially at a 90° or greater angle to the blade being sharpened. The blade not being sharpened therefore protrudes inwardly at an angle towards the axis of rotation of the grinding wheel. Any obstruction, such as a drive shaft or guard member in the area adjacent the side of the wheel, must be kept at a minimal distance from the side of the wheel to avoid interference. The handle of the unground blade similarly protrudes in the opposite direction away from the grinding wheel. The clamp must, therefore, securely clamp the blade being sharpened while allowing lateral clearance at the rear of the clamp jaws to avoid interfering with the handle of the blade.

Further, with most prior art devices, the configuration, strength and clamping effectiveness of the clamp fixture has been a compromise to permit clearance of the handle and blade of the scissors not being sharpened. Such devices often twist or deflect during operation.

Blades of scissors and other cutting tools typically may be flat, of uniform cross-section or thickness, or more commonly tapered in thickness from the fulcrum point outwardly toward the end of the blade. With the present design, the clamp includes a moveable clamp jaw designed as a unique rigid one-piece yoke which engages two opposite guide slots prohibiting front and back movement of the moveable clamp while allowing free lateral movement. The design applies equal and direct pressure throughout the clamp jaws and permits the moveable clamp jaw to compensate for blade taper. Thus, the clamp jaws bear uniformly on both the top and bottom of the blade along the entire length of the clamp portion providing stable and secure clamping condition. The present invention also provides the ability to pre-set an exact angle to be sharpened and repeatable at any time.

Figure 1:
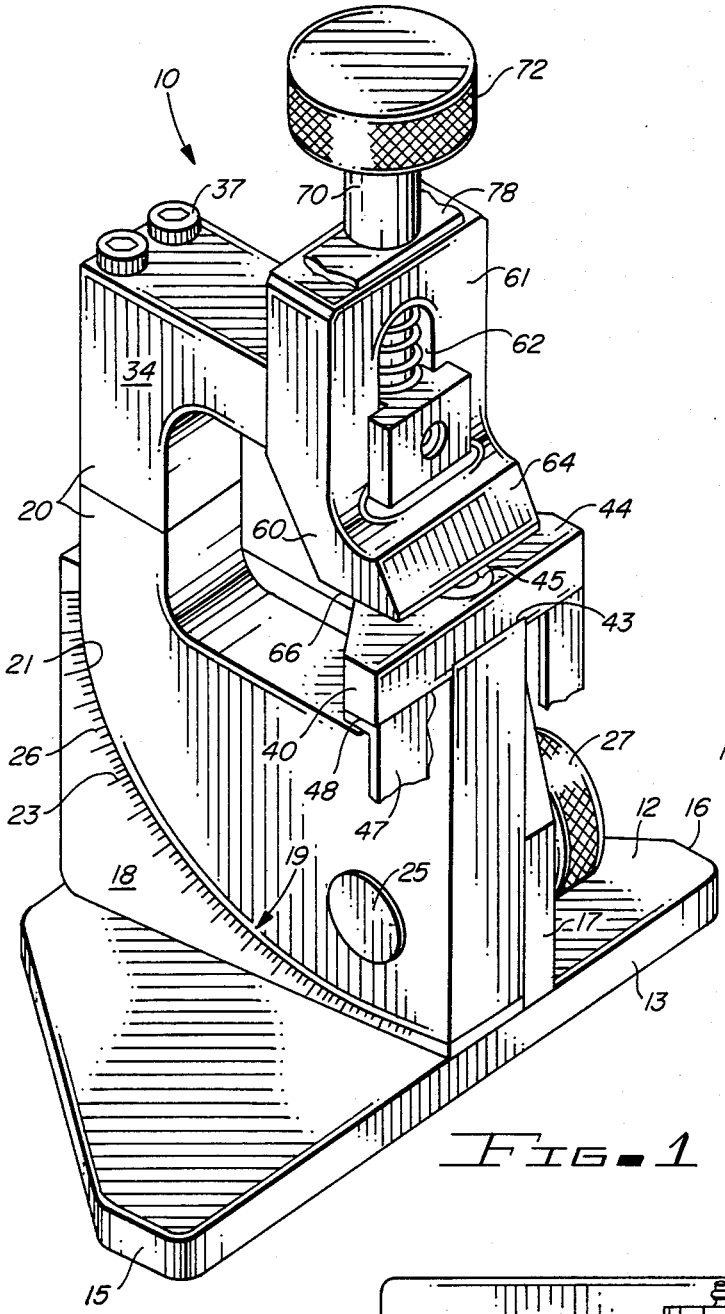
FIG. 1 is a perspective view of a preferred form of the clamping device of the present invention.
Figure 2:
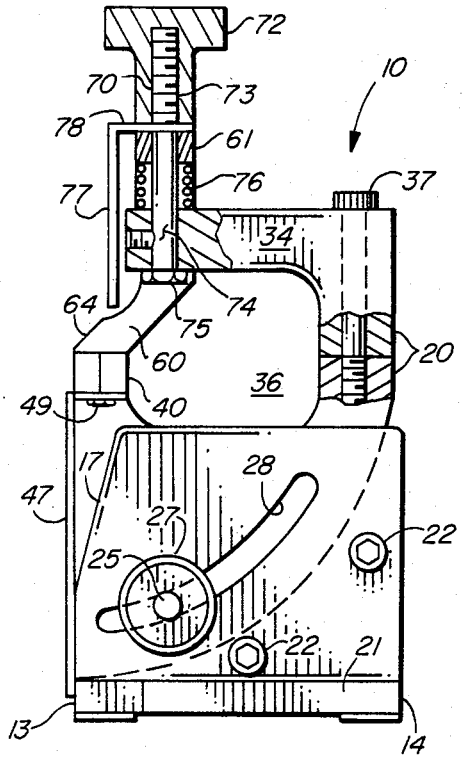
FIG. 2 is a side elevational view of the clamping device of the present invention.
Figure 18:
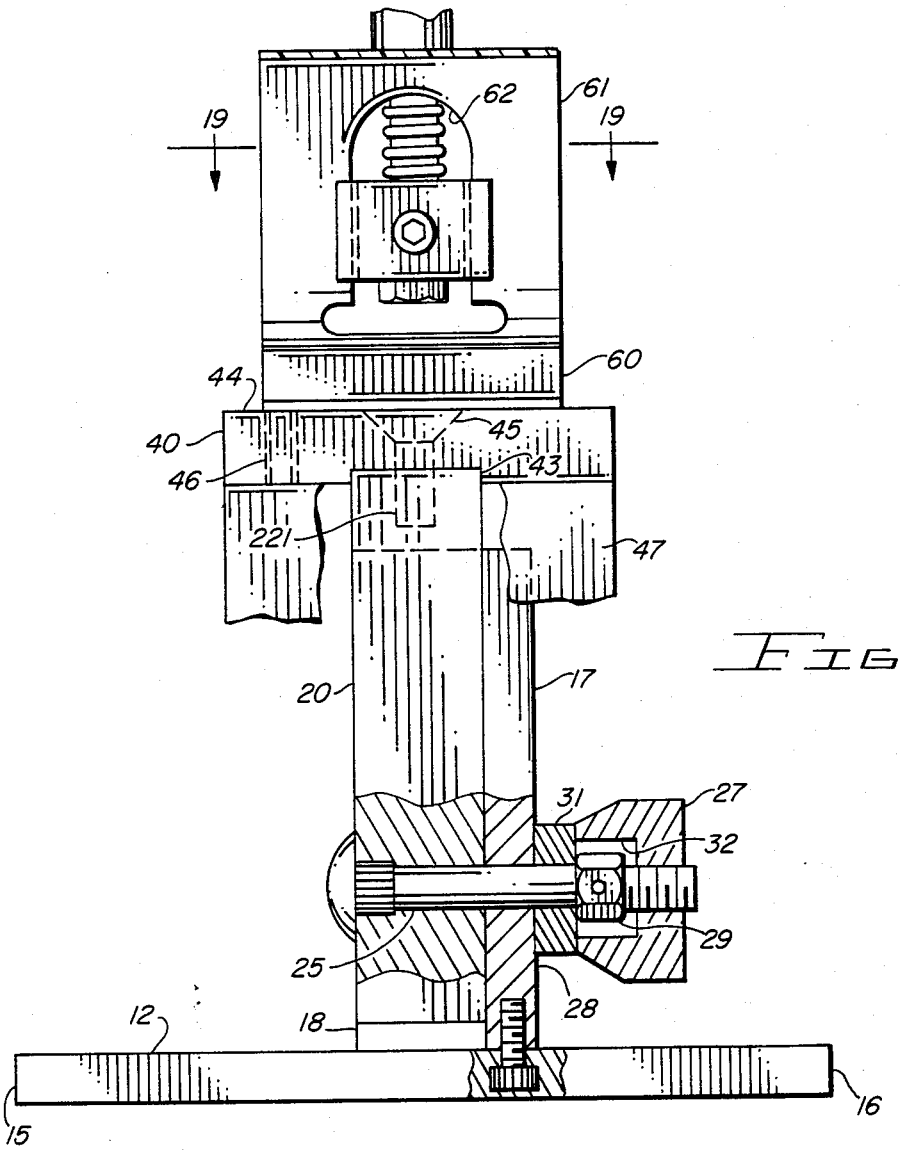
FIG. 18 is a front view, partly broken away, of the clamp.

Turning to the drawings, the device 10 as generally seen in FIGS. 1, 2 and 18 includes a base member 12 shown as trapezoidal having parallel front and rear edges 13 and 14 and opposite side edges 15 and 16. Vertically upstanding pedestal 17 is secured to base 12. A bearing plate 18 having an upper arcuate surface 21 is secured to the left side of pedestal 17, by countersunk mechanical fasteners 22. Bearing plate 18 is preferably fabricated from a suitable low-friction material such as nylon to permit easy sliding movement of the frame as will be explained. Indicia 23 are provided in the bearing plate adjacent arcuate surface 21 indicating on a suitable scale the angular deviation from zero degrees to plus (+) 45 and minus (−) 10 degrees. The curvature of arcuate surface 21 is struck on a radius from point 11 which is located approximately $\frac{1}{8}$" forward of lower jaw 44 on the horizontal center line of the associated grinding wheel as seen in FIG. 4C.

The clamp of the present invention further includes an open frame 20 to provide clearance for the tool and with the associated grinding apparatus. Frame 20 is generally C-shaped having a lower curved edge surface 26 which slidably engages the arcuate portion 21 of the pedestal and has a cooperating reference mark 19 thereon. An arcuate slot 28 is provided in the lower part of pedestal 17. Bolt 25 extends transversely through frame 20 and and through slot 28 having a threaded outer end. The bolt is splined adjacent its head and received in cooperative slots in the frame to prevent the bolt from turning. A separator washer 31 is interposed between pedestal 17 and nut 29 which is swaged on bolt 25 to prevent rotation thereabout. As best seen in FIG. 18, knob 27 is recessed at 32 to accomodate nut 29 which is in threaded engagement with the bolt. It will be apparent that by loosening knob 27 to retract it outwardly frame member 20 is freed permitting frame 20 to be rotated relative to pedestal 17. Retightening knob 27 operating through washer 31 locks the frame in a selected angular position relative to calibrated bearing plate 18.

Figure 19:
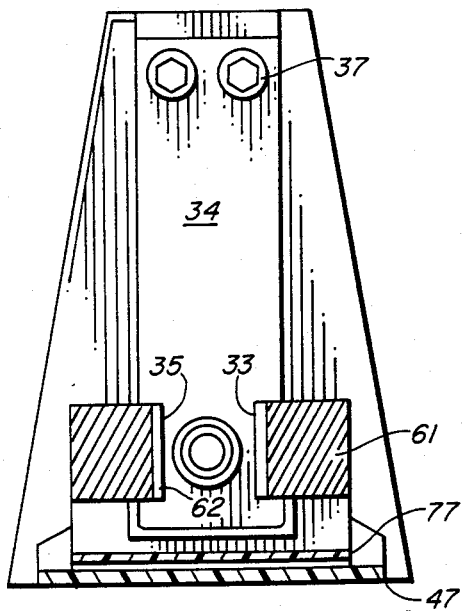
FIG. 19 is a sectional view taken along lines 19—19 of FIG. 18.

Frame 20 further includes a forwardly extending cantilever arm 34 defining opposite guide slots 33 and 35 at the forward end of the arm, as seen in FIG. 19. The frame body defines a substantial interior clearance space 36 rearward of the jaws which permits the handle of the blade not being sharpened to easily pass through the frame without interference. Accordingly, the scissors being sharpened can be opened as widely as its design permits for convenient sharpening. As shown, for convenience frame 20 may be manufactured in several parts and joined by a mechanical fastener such as cap screws 37.

Figure 4A:
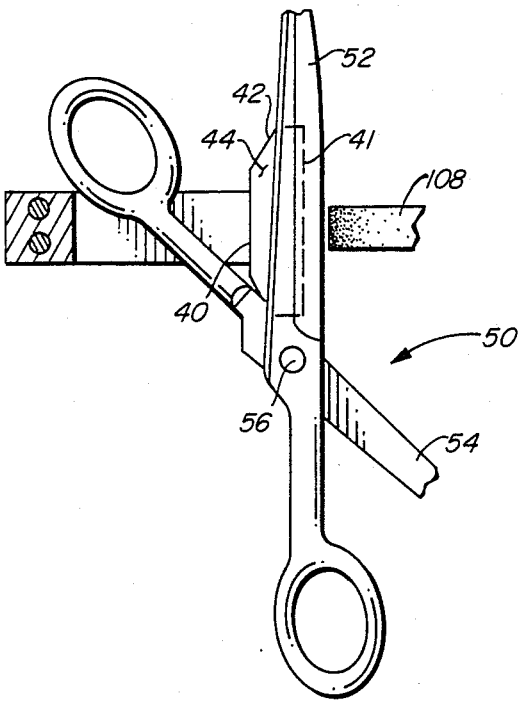
FIG. 4A illustrates a conventional scissors in the clamping device at one side of the grinding wheel.
Figure 4B:
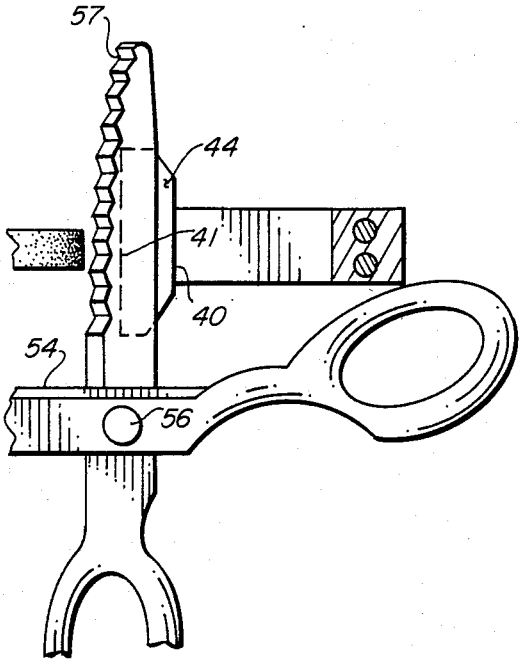
FIG. 4B illustrates a pinking shears in the clamping device located at the side of the grinding wheel opposite that shown in FIG. 4A.
Figure 4C:
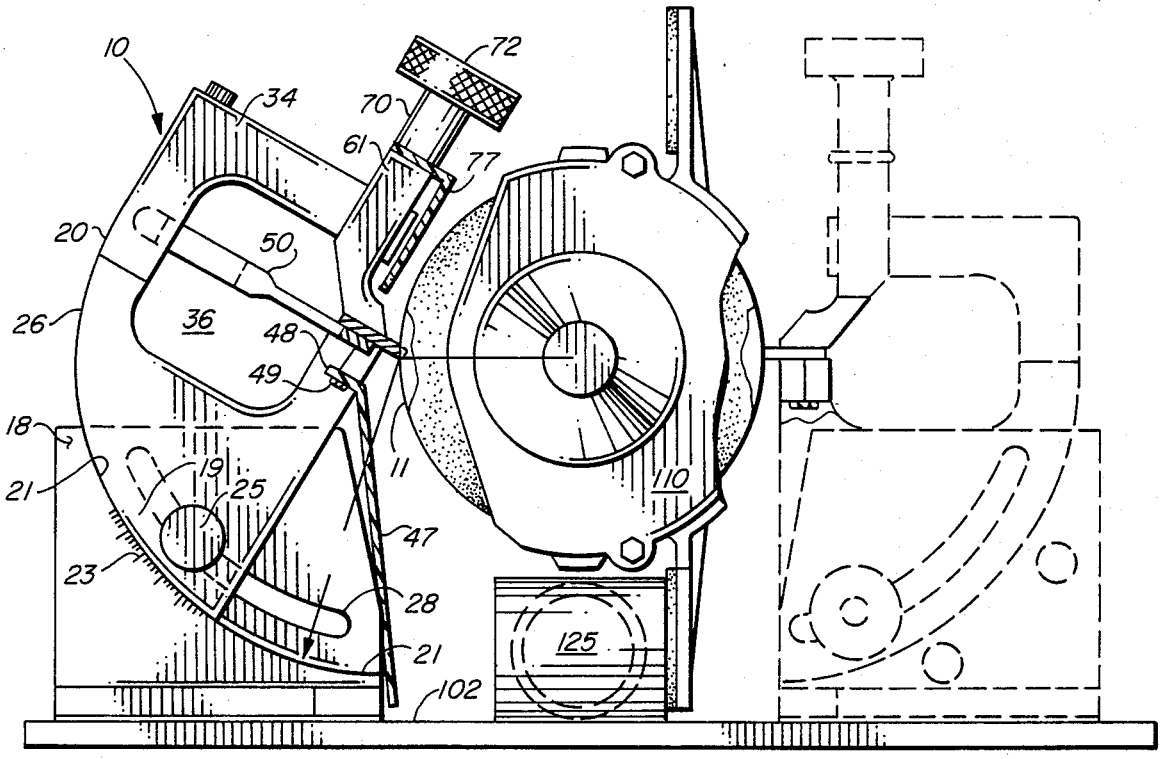
FIG. 4C is a side elevational view showing the clamp alternately positioned at the opposite sides of the grinding wheel.

In the sharpening position as best seen in FIGS. 4A and 4B, scissors 50 to be sharpened has opposite blades 52 and 54 pivotally joined at fulcrum 56. The blade 52 in the sharpening position is secured with its flat side engaged fixed jaw 40. Fixed jaw 40 is secured to frame 20 at the forward side of opening 36 having its front vertical surface 41 aligned with the front of frame 20. Jaw 40 extends transversely having an upper surface 44 which serves as a platform for receiving the scissors to be sharpened. As best seen in FIG. 4A, the opposite sides of fixed jaw 40 are chamfered at the inside at 42 to provide clearance for the blade and handle not being sharpened.

Jaw 40 has a central recess 43 in its underside which receives the upper end of frame 20 and secured thereto by recessed flat head screw 45. Jaw 40 is thus secured by a single fastener and is restrained from rotation. Threaded bores 46 extends through the jaw at opposite sides of the frame.

A lower deflector shield 47 is provided at the front of frame 20 and is shown having a substantially rectangular face having a width approximately corresponding to that of the jaw and depending to a location just above the base. The shield is transparent and protects the clamp from grit as well as spent grinding media and deflect fine hot metal chips (sparks) and grinding media toward the vacuum inlet to effectively collect all discharged material throughout the operation. Shield 47 is secured to jaw 40 by threaded bolts 49 extending through lip 48 at the upper end of the shield. Bolts 49 are in threaded engagement with the bore 46 in the jaw.

The upper platform surface 44 of the fixed jaw is a locating surface for the sharpened edge of the scissors blade and is positioned at the same elevation as the horizontal centerline of the grinding wheel as, for example, is shown in FIG. 4C. The scissors blade to be sharpened preferably extends approximately one eighth inch beyond the front face of the clamp jaws during sharpening.

In instances where the blade edge must be located with a clearance other than one eighth inch, the set angle remains highly accurate as the ratio of the length of the pivotal radius to the length of the blade edge rotation is very large. Therefore, precise setting of the one eighth inch is desirable but not critical.

The blade to be sharpened is secured against the lower fixed jaw by an upper moveable jaw 60. The upper moveable jaw is constructed as part of a rigid one-piece yoke 61 having a vertical slot 62 which is slidably engaged in the two opposite vertical slots 33 and 35 at the forward end of cantilever arm member 34. In this way the moveable jaw can be vertically adjusted. Forward and rear movement of the yoke is restrained by the slots 33 and 35. As seen in FIG. 19, the relationship of the transverse dimension of slot 62 in the yoke to the transverse dimension between slots 33 and 35 at the forward end of the frame arm 34 is established with clearance so that some free lateral movement of the upper moveable jaw is permitted.

Moveable jaw 60 further includes a forwardly inclined lower section 64 terminating at lower work engaging surface 66. Work engaging surface 66 extends transversely a distance approximately corresponding to the width of lower fixed jaw 40. The forwardly projecting upper jaw configuration allows adequate clearance when the frame is tilted so as to avoid interference with the grinding wheel as best seen in FIG. 4C.

Figure 9:
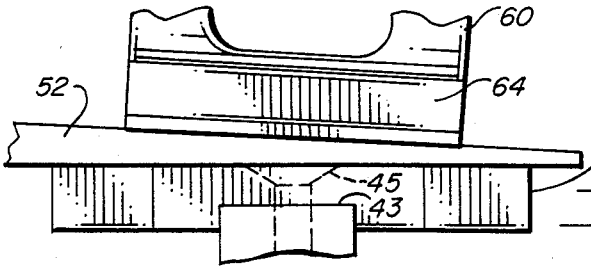
FIG. 9 is a longitudinal view illustrating the position of the blade to be sharpened in the clamping jaws of the device of the present invention.

Adjustment of moveable jaw 60 is accomplished by means of adjusting member 70 terminating at upper end at large knurled knob 72. Adjusting member 70 is internally threaded at 73 and is in engagement with vertical extending bolt 74 and engages the forward end of arm 34. The lower end of bolt 74 is secured at the underside of arm 34 at bolt head 75. Biasing spring 76 extends between the upper surface of arm 34 and the transverse surface of slot 62 in the yoke 61 and urges the jaw to the open position to facilitate one-handed operation. It will be seen that by rotating knob 72, yoke 61 is advanced and retracted relative to the arm 34. This, in turn, will cause the upper jaw 60 to advance and retract relative to the lower fixed jaw 40. Both the upper and lower jaws have a substantial lateral dimension to apply a clamping force over the substantial length of the blade to be sharpened. Further, since the upper jaw is permitted some lateral movement, the upper jaw will tilt to conform to the configuration of the blade as best shown in FIG. 9. The clamp is easily adjustable with one handed operation particularly since the moveable jaw is spring biased to an open position. The jaws apply equal and direct pressure throughout the length of the clamp jaws. The jaw members bear squarely on both the top and bottom side of the blade to be sharpened for a substantial portion of the length providing a very secure clamping condition.

An upper deflector shield 77 of transparent material is secured at lip 78 between the adjusting member 70 and yoke 61. The upper deflector, along with the lower deflector, direct spent grinding indicia and chips away from the clamp toward the vacuum system so they do not become lodged in the clamp parts causing unnecessary wear.

Figure 3:
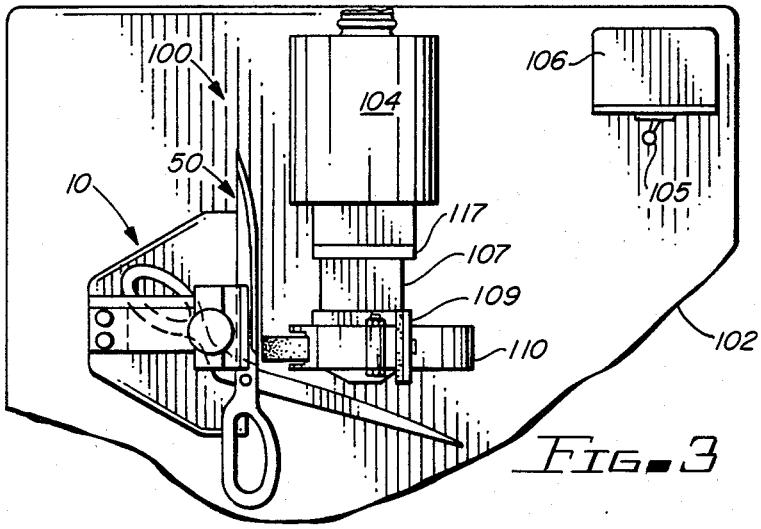
FIG. 3 is a plan view showing the clamping device of the present invention in connection with a cooperative grinding wheel which together form the grinding system of the present invention.
Figure 5:
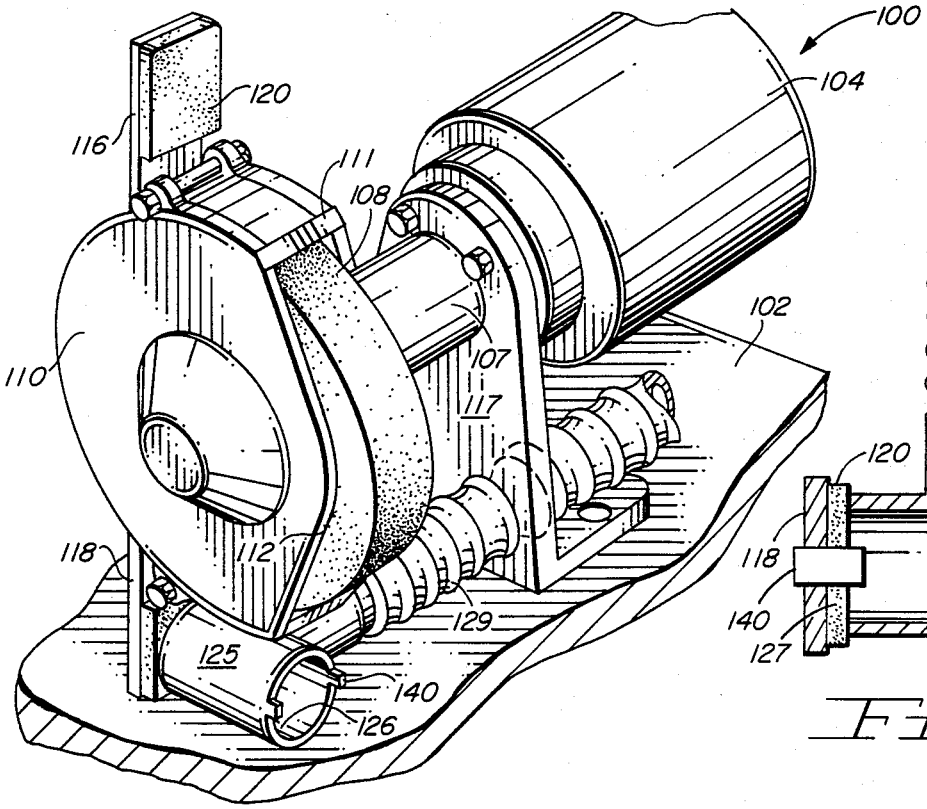
FIG. 5 is a perspective view of the grinding wheel apparatus of the invention with a safety guard and associated vacuum system.
Figure 6:
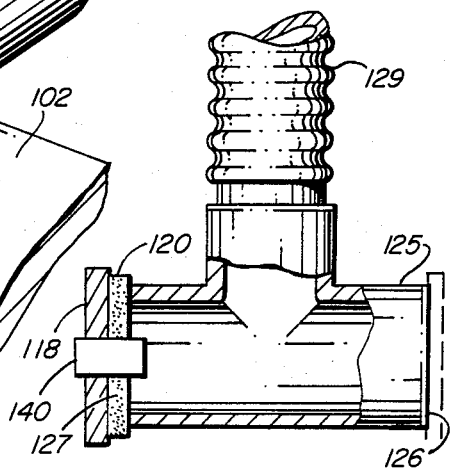
FIG. 6 is a detail view of the vacuum system inlet associated with the grinding apparatus shown in FIG. 5.
Figure 7:
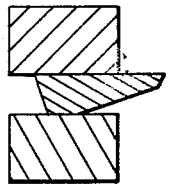
FIG. 7 (PRIOR ART)
FIG. 7 is a cross-sectional view illustrating prior art positioning of a scissors blade to be sharpened in a clamping device.
Figure 8:
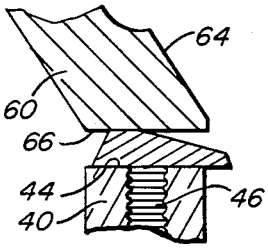
FIG. 8 is a cross-sectional view showing the positioning of a blade in the clamping jaws of the device of the present invention.

The clamping device of the present invention as described above is independent and freestanding and may be used with any conventional grinding apparatus. However, a preferred form of grinding apparatus is shown in FIGS. 3, 5, and 13 and is generally designated by the numeral 100. The grinding apparatus includes a horizontal base 102 having an upstanding mounting bracket 117 for securement of a reversible drive motor 104 operated by control switch 105 at box 106. Switch 105 has three positions, "off" and one "on" position for each rotational direction. Details of the electrical components, wiring and switches are conventional and known to those skilled in the art and further detailed discussion is not deemed necessary.

Motor 104 has a drive shaft, not shown, which is operatively connected to drive grinding wheel 108 which is mounted for rotation in suitable bearings within cylindrical housing 107. The wheel itself can be of any suitable material such as a diamond wheel, a common grinding wheel, metallized wheel, and the like. The grinding wheel 108 is partially shrouded or enclosed by a guard or cover 110. Guard or cover 110 has a generally circular configuration with the forward edge of the enclosure being cut away at 112 to expose a portion of the grinding wheel 108. Cover 110 is rotatable about housing 107 at sleeve 109. The opening exposure at the face of the grinding wheel 108 is selected in accordance with OSHA and ANSI standards and is shown as 62° on either side of the horizontal centerline of the grinding wheel. The cover can be fabricated from any suitable material such as an injection molded impact resistant plastic. To provide additional clearance at the cantilever arm 34 of the clamp, particularly as wheel wear occurs, the top and bottom peripheral edges of the cover at the opening are flattened at 111.

The wheel guard 110 includes an attached bar 114 having oppositely projecting tabs 116 and 118 each covered with an appropriate resilient pad 120. The tabs 118 and 116 are adapted to engage either side of a tee fitting 125 which is positioned on base 102 below the wheel to close one or the other openings 126, 127 of the tee fitting. Spring clips 140 may be provided on the tee inlets to frictionally engage the tabs 116 and 118.

Grinding can be carried out at either side of the grinding wheel 108. This is accomplished by simply rotating the guard 110 to the selected position depending on the grinding operation. Fitting 125 is connected via flexible hose 129 to a vacuum source, not shown, to form an exhaust duct for carrying away dust, grit and metal particles during the grinding operation. Full suction is applied at the working side of the wheel.

The clamp and sharpening system of the present invention will become more fully understood from the following description of operation. The free-standing clamp device 10 is symmetrical and freely moveable from one side of the grinding wheel 108 to the other. Regular scissors are sharpened on the left of the wheel with the wheel rotating counterclockwise as seen in FIG. 4C. Irregularly shaped blades, such as pinking shears, are sharpened on the right side of the wheel with the wheel rotating clockwise. Therefore, the operator first establishes the relationship of the free-standing clamp to the wheel in accordance with the sharpening operation. The overall system is designed with operator safety as a primary consideration. The operator is positioned perpendicular to and away from the rotation of the grinding wheel, a working relationship not existing with prior art devices.

Once the clamp and grinder are positioned, the scissors to be sharpened is placed in the clamp 10 and with a conventional scissors such as scissors 50 shown in FIG. 4A, the inner, flat side of the blade is placed in engagement with surface 44 of the lower fixed jaw. Clamping knob 72 is turned until surface 66 of the upper jaw 60 tightly engages the upper surface of the scissors blade. Note that the moveable jaw 60 will pivot laterally to fully and securely clamp the blade in place. The clamp design applies equal and direct pressure throughout the clamp jaws and permits the moveable clamp jaw to compensate for blade taper. The clamp member bears firmly on both the top and bottom of the blade along the entire length of the clamp portion of the blade providing a very stable clamping position.

When the handle of the scissors blade not being sharpened is passed through the frame, the scissors cannot be accidentally closed as the rear portion of the frame 20 will prevent the handle from rotating toward the closed position. The chamfer 42 at the outer edges of the lower or fixed jaw 40 further accomodates positioning of the scissors as is best seen in FIG. 4A. The open frame design further allows the scissors to be opened as widely as its design permits for convenient sharpening as best illustrated in FIG. 4.

Figure 12:
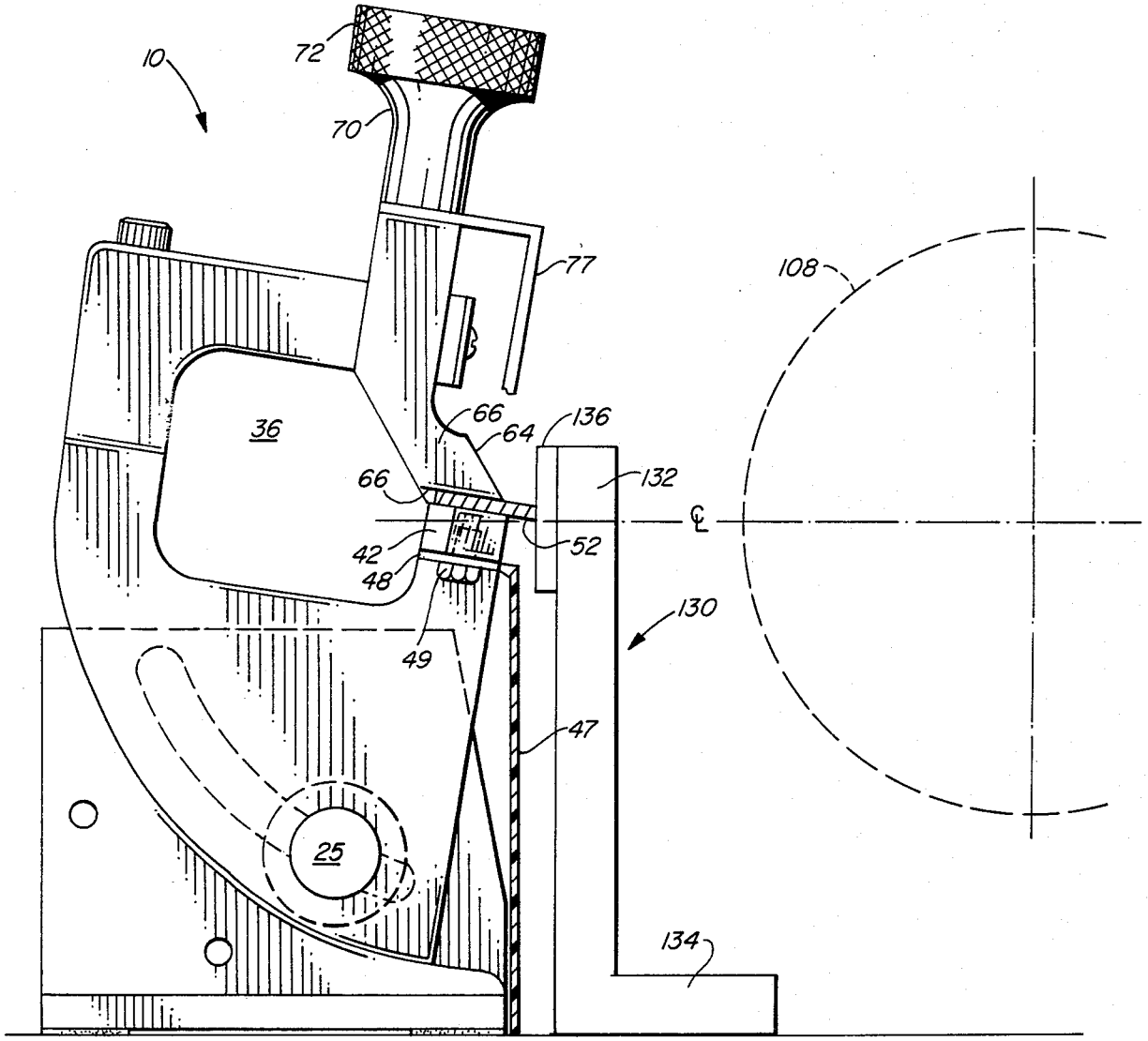
FIG. 12 is a side elevational view showing the positioning of the clamping device relative to the centerline of the wheel with the present invention and further showing a master upright guide for establishing the proper blade grinding angle.

The present invention permits the blade angle to be precisely set and repeated. The lower jaw 40 serves as a locating surface for the sharpened edge of the scissors blade and, as best seen in FIG. 12, is positioned at an elevation corresponding to the horizontal centerline of the grinding wheel. The blade is positioned with the edge to be sharpened extending approximately one eighth inch beyond the extremity of the jaw. As has been mentioned previously, the precise setting of the one eighth inch clearance dimension is preferred but is not critical.

Figure 10A:
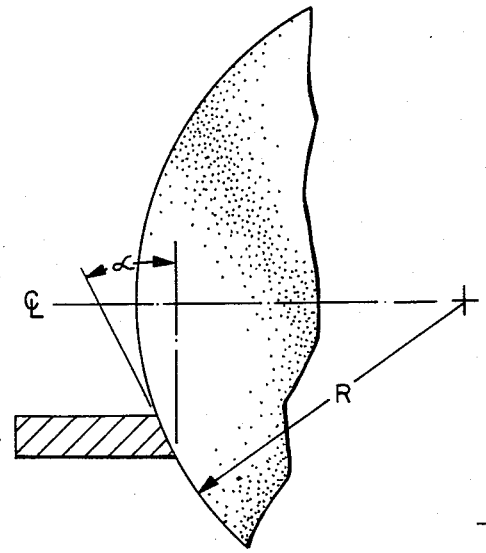
FIG. 10A (PRIOR ART)
FIGS. 10A and 10B illustrate the position of the blade relative to the centerline of the grinding wheel typical of prior art devices showing the blade angle change resulting from grinding wheel wear.
Figure 10B:
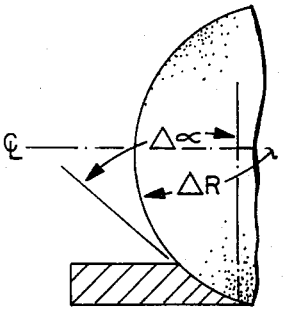
FIG. 10B (PRIOR ART)
Figure 11A:
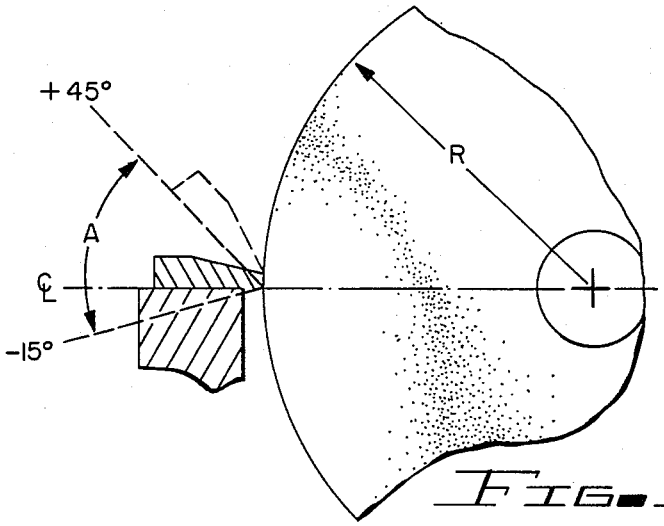
FIGS. 11A and 11B show the blade location relative to the centerline of the wheel with the present invention illustrating the minimal blade angle change resulting as wheel wear occurs.
Figure 11B:
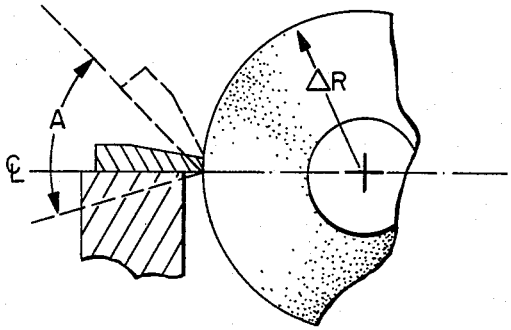

Referring to FIGS. 11A and 11B, the edge to be sharpened will always be presented to the wheel at the correct pre-set angle regardless of wheel wear. The curvature of the ground surface of the blade will gradually decrease in radius for a given set angle as the grinding wheel wears, however, the cutting edge to be sharpened will remain at substantially the same angle. Further, the curvature radius produced by the O.D. of the grinding wheel can be minimized by tilting the grinding wheel at an angle with respect to the scissors blade. However, if a relatively large diameter grinding wheel is used, this curvature will be minimized. In contrast, FIGS. 10A and 10B illustrate the deviation in blade angle ($\alpha$) that occurs as the wheel radius decreases ($\Delta R$) due to wear as experienced with prior art devices and demonstrates the resulting inacuracy that can occur with such devices.

To establish the precise grinding angle several methods can be employed. In some cases reference can be made to manufacturer's recommended standards. Another convenient method is to use a common machinist's protractor with a pivotal angle indicating arm to pre-measure angles. The angle of the blade can be measured in this way and the clamp adjusted to the corresponding angle simply by loosening the lock knob 27 and tilting the frame 20 to the required angle by reference to the indicia 23 on the fixed bearing member 18 and the cooperative reference mark 19 on frame 20. The clamp is then adjusted and retightened at the predetermined angle.

Another approach is indicated in FIG. 12. In this figure, clamp 10 is shown in conjunction with a master upright 130. The master upright includes a post 132 mounted on a base 134. The post 132 is perpendicular and square with respect to base 134 and the clamp fixture. The post has a master edge 136 at an elevation corresponding to the horizontal centerline of the grinding wheel. The blade 52 to be sharpened is clamped in the fixture and the edge of the blade is brought in contact with the master edge 136 at the upper end of the post. The frame 20 of the clamp is then rotated until the edge to be sharpened is parallel and in full contact with the master edge 136 as is shown. At this point the correct sharpening angle is established and the frame is then locked in this position at locking knob 27.

The sharpening operation proceeds with the operator bringing the blade into contact with the grinding wheel and moving the blade laterally of the wheel. The machine is best operated with the operator standing or sitting in one position perpendicular to and away from the rotating grinding wheel. One hand is used to move the blade and the other hand, operating through the fixture, maintains light, even contact between the edge and the grinding wheel. Sharpening an edge can normally be accomplished in a single grinding pass which results in minimum removal of material prolonging the useful life of the tool. One-pass sharpening also minimizes and reduces frictional heating which can adversely affect the temper in blades.

The rotatable guard 110 locks in place and serves as an additional safety feature for the operator. To insure that the guard is in place, the positioning of the guard at the selected side of the grinding wheel will also result in the closure of one of the vacuum inlets 126 or 127. Grinding operations are typically messy because of the substantial amount of grit produced from the grinding wheel and the workpiece. The grit collects on the grinding apparatus and the operator. The suction system of the invention is effectively located to remove grit and contamination produced in the operation. Full suction is directed to the working side of the wheel when the guard is rotated. The vacuum or suction creates low pressure and as the clamp mechanism passes the vacuum inlet, higher pressure air is partially restricted from moving in a direct path to carry grit to the low pressure zone. This restriction of free air movement may cause some grit to adhere to the clamp. The wide resilient plastic deflection shield 48 serves to deflect the metal chips and sparks as well as grinding media away from the clamp toward the vacuum inlet.

The sharpening of the workpiece is accomplished from one side of the machine eliminating the necessity of operator movement around the machine. The diameter of the wheel and the side of the clamp face the operator to provide an unobstructed view of the workpiece. This is particularly advantageous in sharpening of knives and scissors blades as the operator views the entire axial length of the blade of the workpiece during sharpening and can anticipate changes in blade curvature and properly guide the fixture with accuracy. With the invention, the depth of the cut or trueness of the original shape of the blade is accurately maintained as the axial length of the blade is pulled parallel to the face of the wheel with one hand while the operator's other hand maintains contact between the wheel and blade.

With many prior art devices the clamp mechanism is located between the operator and the wheel and consequently both hands are necessary to feed the blade into the wheel while moving the blade along the axial length. With this positioning and the inability to view the entire axial length of the blade and anticipate changes in blade curvature, it is difficult for an operator to produce a proper cut which often results in a wave or irregular edge being formed on the scissors. It is also noted that with the fixture of the invention one hand is used to hold and pull the handle of the blade being sharpened and an insecurely clamped blade condition would be immediately detected. This reduces likelihood of accident.

FIG. 13 shows a modification of the present invention in which the clamp or fixture 10 and grinding member 100 comprising the grinding system are commonly mounted on a planar base 102 having an upstanding flange 152 at the side edge of the base. Clamp 10 is moveably positioned against carriage 160 which can be advanced or retracted along base 102 by lead screw 165 by rotating knob 166. In other respects, this embodiment is as has been described before. Although the primary object of the invention is to permit the convenient and accurate sharpening of blades with curved shapes, the invention is adaptable for sharpening straight edges 170 as shown in FIG. 13. In this event the workpiece is clamped parallel to the clamp jaws which are parallel with the rear of the clamp fixture. The straight edge tool 170 is adjusted inward to the correct depth and the fixture can thus be guided in a true straight path parallel to the centerline of wheel along carriage 160 to insure a uniform, straight edge.

The present invention can also be utilized to sharpen other cutting tools such as knives. The overall operation of the clamp or fixture 10 remains essentially the same while the configuration of the lower clamp jaw is modified from the one-piece construction previously described. As best seen in FIGS. 14 and 15, the lower jaw is a two piece member to accomodate sharpening devices such as knives which are sharpened at opposite sides of the blade to an included angle. As seen in these figures, the lower jaw generally designated by the numeral 200 includes an upper section 210 and a lower section 213. The lower jaw 213 is secured to the upper end of the frame 20 of the clamping member by a countersunk flat head screw 221 and is restrained from rotation by engagement of recess 222. The lower jaw has a generally horizontal upper surface 218 and an angular work clamping surface 212 which defines an angle of typically about 15° with the vertical. A pair of studs 224 and 226 are spaced apart at opposite sides of the pedestal through the lower jaw. The lower ends of the studs accept nuts 227 for securing the shield in place.

The upper jaw member 210 has a generally trapezoidal cross-section with an angular work engaging surface 225 corresponding to work engaging surface 212 of the lower jaw. A pair of bores 230 and 232 in the body are adapted to align with studs 224 and 226. Thus, the opposed work engaging surfaces 225 and 212 clamp or secure the tool to be sharpened 240 in place. The upper trapezoidal shaped jaw 210 is moveable on the two studs 224 and 226 which are of adjustable length at threads 242. By manually separating the jaw members 210 and 213 and inserting a workpiece 240 and releasing the upper member 210, a blade is in position. The main clamp or fixture assembly can be adjusted as heretofore described to bring the moveable jaw 60 into engagement with jaw 210 to provide the clamping force. The workpiece 240 can be sharpened to a wide range of included angles at the sharpened edge. With upper jaw 210 in position on studs 224 and 226, the upper surface 245 of the upper jaw member 210 can be used as a working surface to clamp a scissors blade in cooperation with moveable jaw 60 in the same manner as described above.

FIGS. 16 and 17 show still another fixture or attachment 250 for securing a workpiece in the clamping device of the present invention. The attachment comprises a vise having a body 252 including a work holding section 254 with a forward fixed jaw 256. A moveable jaw 258 can be advanced by lead screw 260. The vise body 252 is attachable at the clamp jaws 40 and 60 as best seen in FIG. 17. The device attachment provides the benefit of being freely moveable and adjustable relative to the main fixture and the clamp jaws to permit flexibility in grinding and dressing and in the forming of compound angles. To further increase the flexibility of the device 250, the device may be secured to the main frame by a pivot pin 262 in the lower jaw. This provides the capability of accurately grinding or dressing compound angles at specific radii.

From the foregoing, it will be seen that the present invention provides a unique grinding system which is very simple and efficient. The clamp provides the proper clearance for the workpiece and provides a secure tight clamping action for the workpiece even those workpieces of unusual shape. The clamp applies equal and direct pressure along the clamp jaws and compensates for uneven or nonuniform workpiece shapes. The fixture permits the user to pre-set the angle to be sharpened which can be reset at any time. An additional advantage is that as wear of the wheel occurs, the correct pre-set angle will be maintained. Grinding operations are clean as grit and other substance is immediately removed. The system provides substantial safety benefits to the user as it is easy to use since the entire blade length to be sharpened is readily visible to the operator. Various attachments can be used with the present invention for specialized sharpening applications.

While various specific forms of the invention have been described, it is understood that the form of the invention shown herein and described is to be taken as preferred examples of the same. Various changes in shapes, sizes and arrangement of the parts may be made without departing from the spirit and scope of the appended claims.

We claim:

1. A freestanding manually operable clamping device for use in sharpening a workpiece in conjunction with a rotary grinding wheel having a horizontal centerline, said device comprising:

(a) a fixed base member;

(b) a fixture frame having a fixed jaw member and a moveable jaw member oppositely disposed one to the other at a forward location on said frame and each said jaws having a workpiece engaging surface and a front edge which will face the grinding wheel, one of which surfaces being positionable at the approximate horizontal centerline of the grinding wheel, said moveable jaw being adjustable to vary the space between the surfaces of the fixed jaw and the moveable jaw, one of said jaws being pivotal relative to the other jaw to vary the included angle between the workpiece engaging surfaces, said frame and jaws providing clearance laterally and to a location rearward of said jaws;

(c) said fixture frame and base defining cooperating arcuate surfaces, said arcuate surfaces being defined by a radius of curvature from a center point located forward the front edge of said jaws along said one of said surfaces whereby the edge to be sharpened will be presented to the wheel at a correct pre-set angle;

(d) locking means for selectively securing said fixture frame in a predetermined fixed position relative to said base.

2. The clamping device of claim 1 further including indicia means associated with said base and frame for establishing a predetermined angle of said frame to said base.

3. The clamping device of claim 1 wherein said workpiece engaging surfaces are planar and are of substantial length relative to the blade length of the workpiece and wherein at least one of said jaws has a configuration to provide additional clearance for the said workpiece.

4. The clamping device of claim 1 wherein said fixture frame member has a generally C-shaped configuration having an open clearance space rearward of said jaws.

5. The clamping device of claim 1 further including attachment means in the form of a vise having at lease one moveable jaw, said attachment means being selectively attachable at one of said jaws.

6. The clamp device of claim 1 wherein said fixed jaw comprises first and second members which define at least two work engaging surfaces angularly disposed relative to the workpiece engaging surface of the fixed jaw.

7. The clamping device of claim 1 wherein said workpiece engaging surface of said fixed jaw is positionable at an elevation corresponding to the centerline of the grinding wheel.

8. The clamping device of claim 1 further including a master guide including an upright post having a planar guide portion adapted to engage the surface to be sharpened to establish the desired sharpening angle.

9. The clamping device of claim 1 wherein said locking means comprises a fastener extending through said base and frame having a threaded member thereon which may be loosened or tightened to selectively secure said frame in a predetermined position relative to said base.

10. The clamping device of claim 1 wherein said moveable jaw is biased to a position away from said fixed jaw and is advanceable toward said fixed jaw by adjustment means.

11. An improved freestanding manually operable clamping device for sharpening a workpiece in conjunction with a rotatable grinding wheel having a horizontal centerline, said device comprising:

(a) a base member having an upstanding pedestal secured thereto, said pedestal defining a first pivot surface;

(b) a fixture frame member having a second pivot surface cooperating with said first pivot surface, said fixture member defining a generally open body and carrying a lower fixed jaw thereon, said fixed jaw defining an upper planar working surface and having a lateral dimension adapted to extend substantially along the length of the blade to be sharpened, said working surface being positionable at an elevation corresponding to the centerline of said grinding wheel, said pivot surfaces being generally arcuate and defining a radius of curvature from a center point located generally in the plane of the surface of the lower fixed jaw and forward thereof in a direction toward the grinding wheel, whereby the edge to be sharpened will be presented to the wheel at the correct pre-set angle;

(c) indicia means coincident with said radius of curvature for pre-setting the relative position of said surface to establish a grinding angle;

(d) said fixture frame member including an arm extending to a location above said lower jaw member, said arm defining two generally vertically extending guide slots and providing a predetermined clearance rearward of said jaws to accomodate rearward protruding portions of the workpiece being sharpened;

(e) a moveable jaw member moveable in said guide slots having a generally planar working surface disposed oppositely the working surface of said fixed jaw member, said moveable jaw member being generally transversely pivotal with respect to said arm;

(f) means for advancing and retracting said moveable jaw relative to said fixed jaw; and (g) means for securing said fixture frame member in a predetermined angular position with respect to said base.

* * * * *